US006000066A

United States Patent [19]

Williams

[11] Patent Number: 6,000,066

[45] Date of Patent: Dec. 14, 1999

[54] EXERCISE HELMET

[75] Inventor: Thomas E. Williams, 5535 Elm Spring, Houston, Tex. 77048

[73] Assignee: Thomas E. Williams, Houston, Tex.

[21] Appl. No.: 09/174,675

[22] Filed: Oct. 19, 1998

[51] Int. Cl.[6] ..... A42B 3/00; A63B 23/025

[52] U.S. Cl. ..... 2/422; 2/209.13; 482/10; 482/105

[58] Field of Search ..... 2/410, 422, 425, 2/209.13; 482/10, 105

[56] References Cited

U.S. PATENT DOCUMENTS

| | | | |
|---|---|---|---|
| 2,051,366 | 8/1936 | Catron | 482/10 |
| 2,855,202 | 10/1958 | Kinne | 482/10 |
| 3,128,095 | 4/1964 | Sharkey | 482/10 |
| 4,168,060 | 9/1979 | Hohenfeldt | 482/10 |
| 4,339,124 | 7/1982 | Vogler | 482/10 |
| 4,645,198 | 2/1987 | Levenston | 482/10 |

*Primary Examiner*—Michael A. Neas

[57] ABSTRACT

The exercise helmet of the present invention includes an outer shell which would preferably be constructed of a sturdy plastic, and an inner shell which would function as an impact absorbing liner. Support plates are provided at the sides of the helmet to support shafts which extend outwardly from the support plates. Weighted plates may be placed on the shafts to provide resistance for exercise when the helmet is worn. A yoke accessory is provided for attachment to a cable of a conventional weight machine, for providing resistance instead of the weighted plates. An adjustable chin strap is provided for securing the helmet more securely to a wearer's head, and for increasing the exercise effect on facial muscles.

8 Claims, 4 Drawing Sheets

EXERCISE HELMET

BACKGROUND OF THE INVENTION

1. Field of the Invention

The present invention relates to exercise equipment, particularly for exercising the neck and facial muscles.

2. Description of the Related Art

Several devices have been invented which assist in providing exercise for neck muscles. Some of these devices also provide some benefit for the facial muscles. None have been developed which provide the versatility, customized fit, safety and sturdy construction of the present invention.

SUMMARY OF THE INVENTION

The exercise helmet of the present invention includes an outer shell which would preferably be constructed of a sturdy plastic, and an inner shell which would function as an impact absorbing liner.

Support plates are provided at the sides of the helmet to support shafts which extend outwardly from the support plates. Weighted plates may be placed on the shafts to provide resistance for exercise when the helmet is worn. A yoke accessory is provided for attachment to a cable of a conventional weight machine, for providing resistance instead of the weighted plates. An adjustable chin strap is provided for securing the helmet more securely to a wearer's head, and for increasing the exercise effect on facial muscles.

Still further features and advantages will become apparent from the ensuing description and drawings.

DETAILED DESCRIPTION

Figure 1:
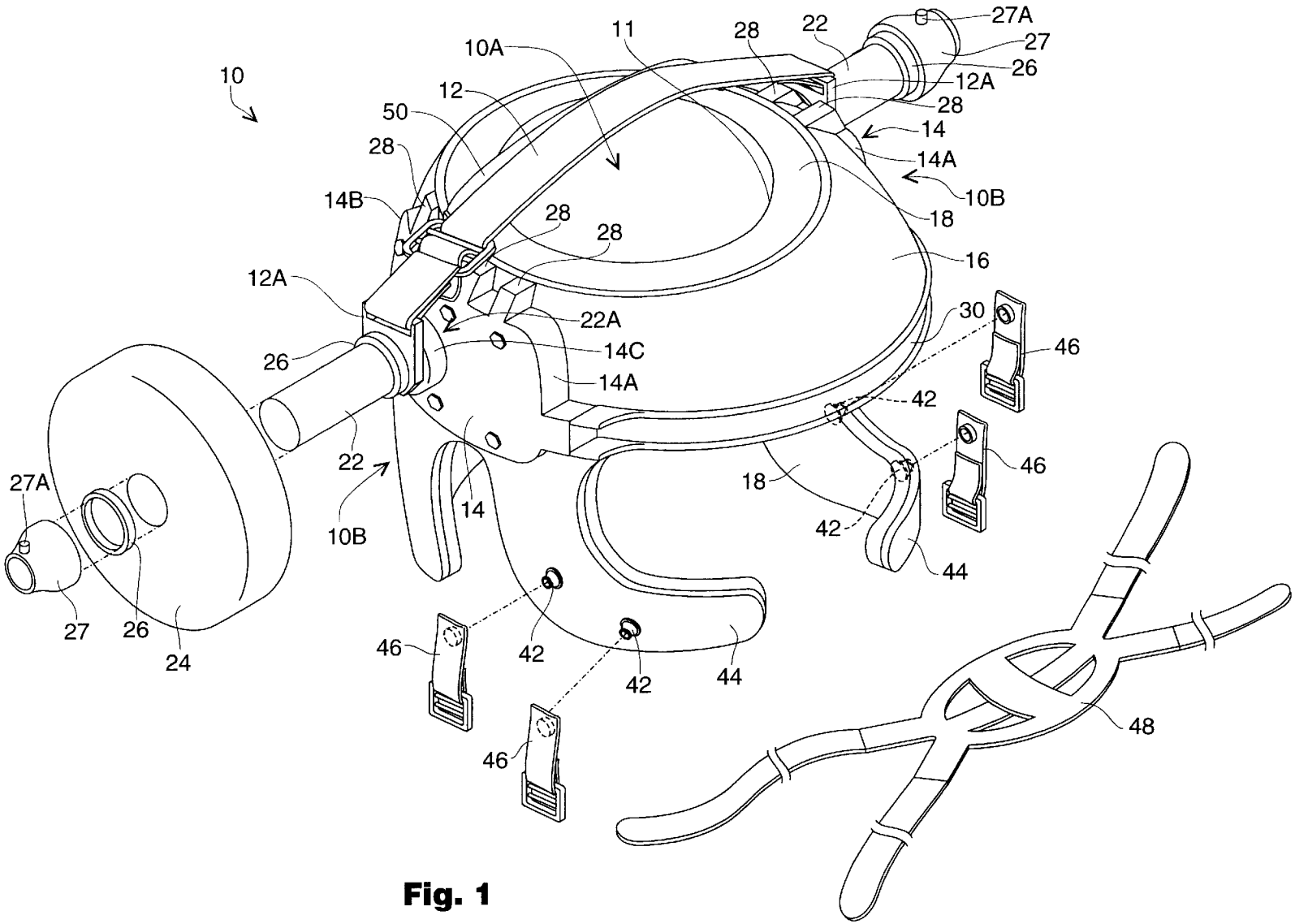
FIG. 1 is a perspective view of the helmet of the present invention, shown with a first strap.

FIG. 1 is a perspective view of a helmet 10 of the present invention, with a first strap 12. The helmet 10 comprises an outer shell 16 which would preferably be constructed of a sturdy plastic with high resistance to impact, such as Acrylonitrile-butadiene styrene, commonly known as ABS plastic. An inner shell 18 would function as an impact absorbing liner, and would preferably be constructed of a high density foam, as is common in motorcycle helmets, bicycle helmets, and baseball and football helmets. The helmet 10 has an opening 11 at a crown 10A of the helmet 10.

Support plates 14 are provided at the sides 10B of the helmet 10, to support shafts 22 which extend outwardly from the support plates 14. Conventionally configured, weighted plates 24 may be placed on the shafts 22 to provide resistance for exercise when the helmet 10 is worn. The first strap 12 provides additional support for the shafts 22 and the weighted plates 24. Rings 26 fit securely about the shafts 22 on each side of the weighted plates 24, to help prevent the weighted plates 24 from wobbling on the shafts 22. A conventional collar 27 such as the one shown, having a thumb screw 27A, or other conventional collar structure, is used in a known manner to maintain the weighted plates 24 in a fixed position on the shaft 22.

Reinforcing members 28 project upwardly from the plates support plates 14 and connect to the outer shell 16 of the helmet 10. A front reinforcing rib 30 spans between front edges 14A of the support plates 14 and reinforces a front portion of the helmet 10.

Figure 2:
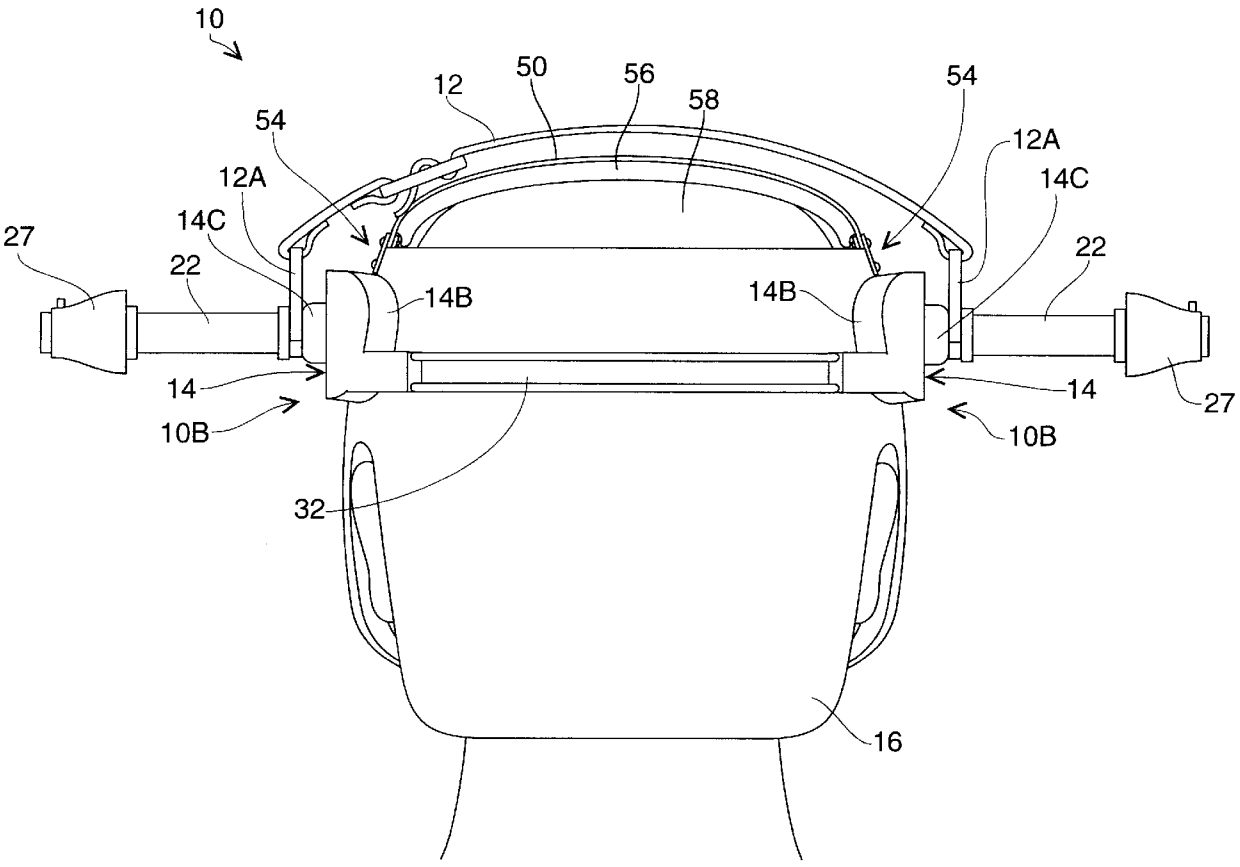
FIG. 2 is a rear elevational view of the helmet.

Referring to FIG. 2, which is a rear elevational view of the helmet 10, a rear reinforcing rib 32 spans between rear edges 14B of the support plates 14 and reinforces a rear portion of the helmet 10.

Referring to FIGS. 1 and 2, an ear 14C extends outwardly from each of the support plates 14 and surrounds a proximal end 22A of the shaft 22, acting as a support anchor for the shaft 22. Anchor rings 12A are connected to each end of the first strap 12. The anchor rings 12A fit about the shafts 22, thus anchoring the first strap to the helmet 10. The anchor rings 12A are each trapped between one of the ears 14C and one of the inboard rings 26.

Figure 3:
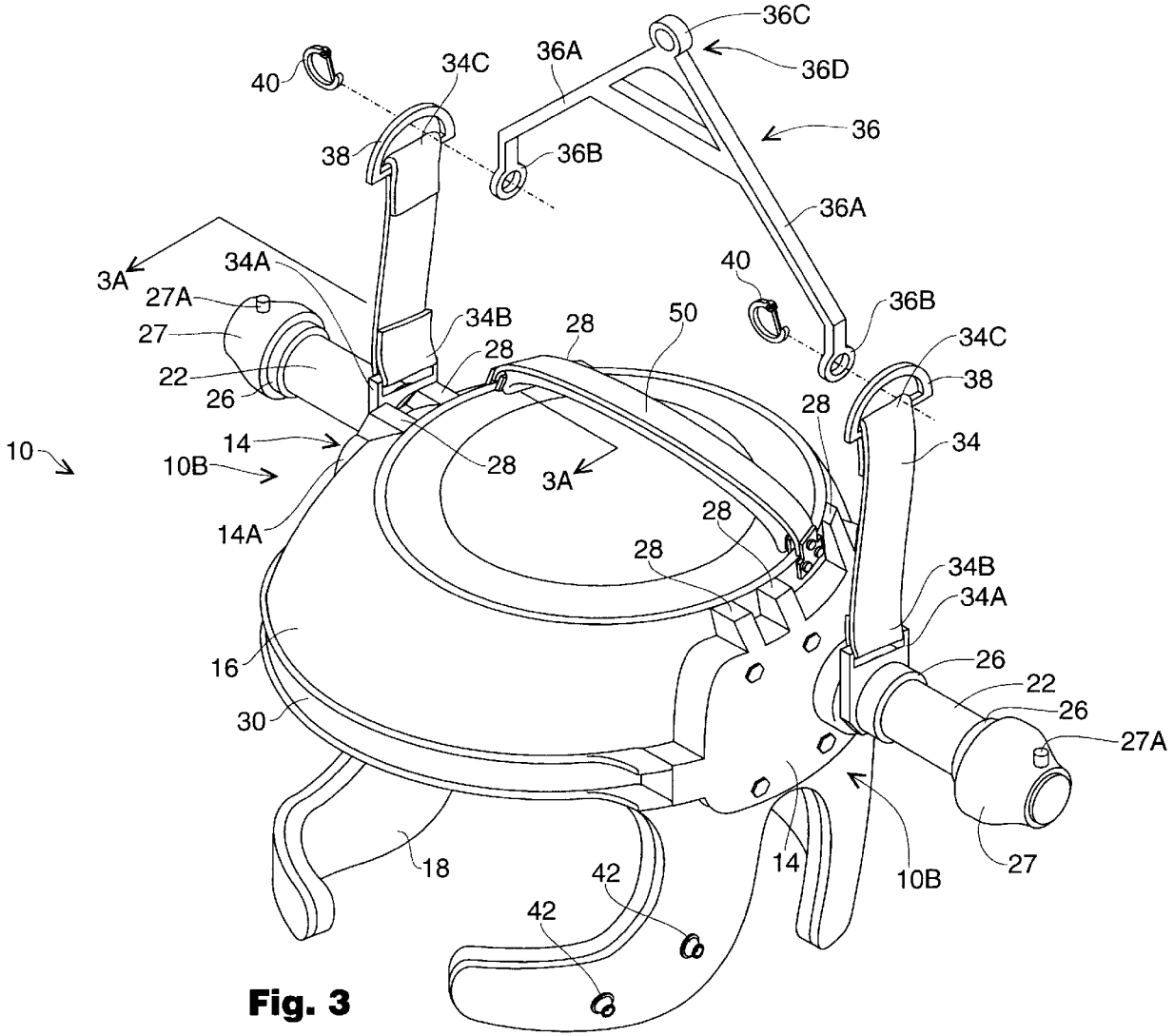
FIG. 3 is a perspective view of the helmet, with a pair of second straps replacing the first strap, and configured for attachment to a yoke accessory.

FIG. 3 is a perspective view of the helmet 10 from a different viewpoint than FIG. 1, with a pair of second straps 34 replacing the first strap 12, and configured for attachment to a yoke accessory 36. The yoke accessory 36 includes two outwardly extending legs 36A having attachment rings 36B at distal ends thereof. The legs 36A extend outwardly from a cable ring 36C at an apex 36D of the yoke accessory 36.

The second straps 34 include anchor rings 34A at the first ends 34B thereof, configured and positioned similarly to the anchor rings 12A already described. Solid D-rings 38 are located at the second ends 34C of the second straps 34. Conventional, spring-loaded openable D-rings 40 are provided for securing the second solid D-rings 38 to the attachment rings 36B, thereby securing the yoke accessory 36 to the helmet 10. The cable ring 36C is for attachment to a cable (not shown) of a conventional exercise machine (not shown) for providing resistance for exercise instead of the weighted plates 24. Although the yoke accessory 36 and the second straps 34 are shown extending upwardly in FIG. 3, they may extend in any direction suitable for the exercise.

Although the solid and openable D-rings 38, 40 are shown and described, other conventional methods of attachment are within the scope of the present invention. Although the first strap 12 is not shown in this view, it may be included in the manner shown in FIG. 1, in addition to the second straps 34.

Conventional snap members 42 are provided on forwardly extending lower side members 44 of the helmet 10, for attachment of buckle members 46 thereto. A chin strap 48 is adjustably connectable to the buckle members 46 for securing the helmet 10 more securely to a wearer's head (not shown). Particularly when the chin strap 48 is used, the muscles of the face will become more involved in contending with the resistance provided by the weighted plates 24, or by the exercise machine (not shown) through the yoke accessory 36, and thus will become exercised in addition to the neck (not shown) of the wearer.

Figure 3A:
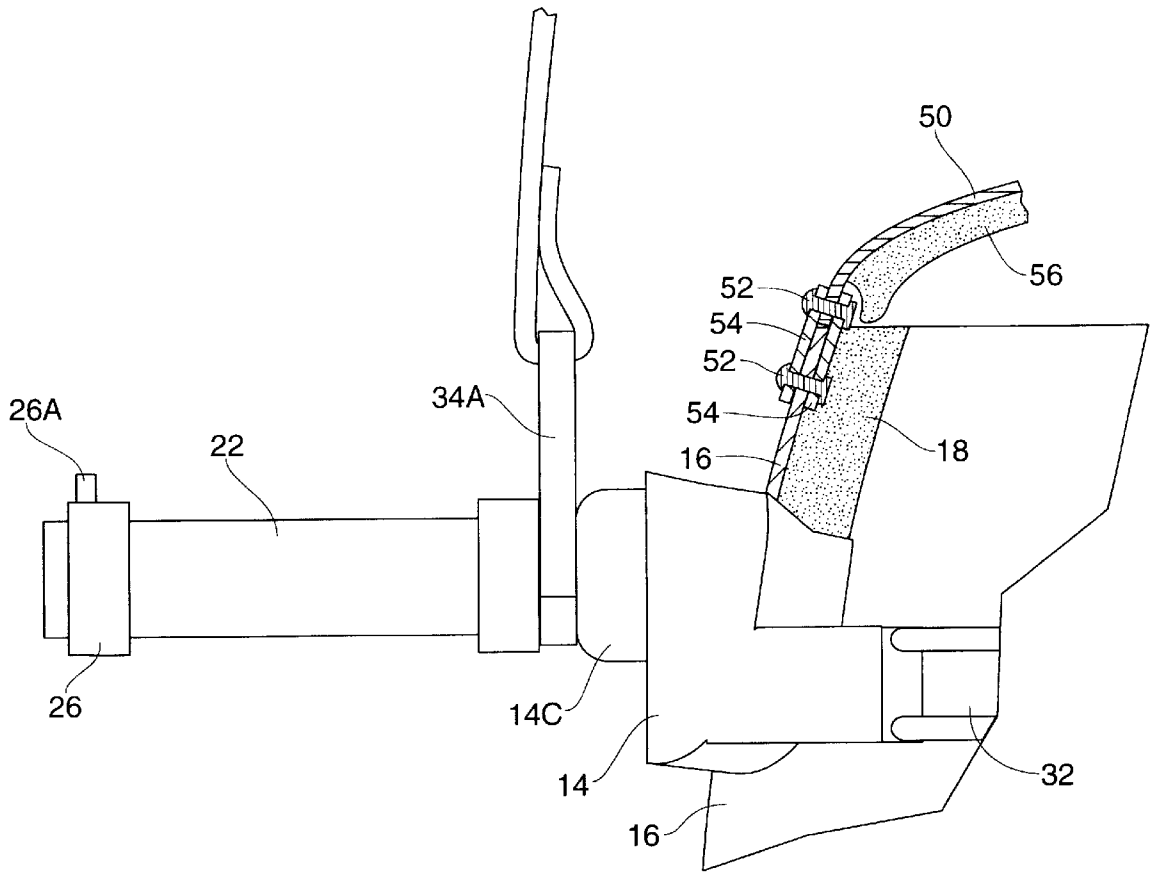
FIG. 3A is a cross-sectional view of the helmet, taken along line 3A—3A of FIG. 3.

FIG. 3A is a cross-sectional view of the helmet 10, taken along line 3A—3A of FIG. 3. Referring to FIGS. 2, 3 and 3A, a crown strap 50 is attached to the opposing sides 10B of the helmet 10, using conventional means such as rivets 52 and strap support plates 54, as shown. A protective pad 56 is attached to an underside of the crown strap 50. The crown strap 50 and the protective pad 56 are preferably constructed of the same materials as the outer shell 16 and the inner shell 18, respectively. The crown strap 50 provides support of the helmet 10 from the head 58 (see FIG. 2) of a user. Although not shown, the crown strap 50 may be made adjustable in a known manner.

Exercises performed while wearing the helmet 10 would include various rotations and tilting of the head of the wearer, for exercise of the neck and facial muscles. Such exercises are already well known for use with known types of neck exercise apparatus, such as head harnesses and specially designed exercise machines.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

I claim:

1. An exercise apparatus comprising:

a. a helmet portion having two sides and a top;

b. each of the sides having a shaft extending outwardly there-from, the shafts adapted to support weighted plates thereon;

c. a yoke assembly configured to connect to the shafts and adapted to connect to a resistance means;

d. an adjustable chin strap configured to connect to the helmet portion;

e. the yoke assembly being generally V-shaped, having an apex and two legs extending outwardly from the apex;

f. a resistance means attachment device positioned at the apex; and g. each of the legs having an attachment ring at a distal end thereof for connection to one of the shafts.

2. The exercise apparatus of claim 1, wherein the resistance means attachment device is a cable ring.

3. An exercise apparatus comprising:

a. a helmet portion having two sides and a top;

b. the top comprising an opening in an approximate center thereof, adapted for a crown of a head of a wearer of the helmet to extend there-through;

c. a support plate provided at each of the sides;

d. each of the support plates having a shaft extending outwardly there-from, the shafts adapted to support weighted plates thereon;

e. a crown strap configured to connect to the two sides and extend across the opening in the top of the helmet;

f. a pair of straps configured to connect to the shafts;

g. a yoke assembly configured to connect to the straps and adapted to connect to a resistance means; and h. an adjustable chin strap configured to connect to the helmet portion.

4. The exercise apparatus of claim 3, wherein:

a. the yoke assembly is generally V-shaped, having an apex and two legs extending outwardly from the apex;

b. a resistance means attachment device is positioned at the apex; and c. each of the legs has an attachment ring at a distal end thereof for connection to one of the shafts.

5. The exercise apparatus of claim 4, wherein the resistance means attachment device is a cable ring.

6. An exercise apparatus comprising:

a. a helmet having a front portion, a rear portion, two sides and a top;

b. a support plate provided at each of the sides;

c. each of the support plates having a shaft extending outwardly there-from, the shafts adapted to support weighted plates thereon;

d. reinforcing members projecting upwardly from the support plates along the sides of the helmet;

e. a front reinforcing rib spanning between front edges of the support plates along the front portion of the helmet; and f. a rear reinforcing rib spanning between rear edges of the support plates along the rear portion of the helmet portion.

7. The exercise apparatus of claim 6, wherein the top comprises an opening in an approximate center thereof, adapted for a crown of a head of a wearer of the helmet to extend there-through, and the reinforcing members terminate at a top edge of the helmet.

8. The exercise helmet of claim 7, further comprising a crown strap configured to connect to the two sides and extend across the opening in the top of the helmet.

* * * * *